United States Patent [19]

Vannier

[11] Patent Number: 5,031,936

[45] Date of Patent: Jul. 16, 1991

[54] BINDING FOR A SAMPLE BOOK

[75] Inventor: Patrice Vannier, Saint Doulchard, France

[73] Assignee: Onis S.A., Bourges Cedex, France

[21] Appl. No.: 441,579

[22] Filed: Nov. 27, 1989

[30] Foreign Application Priority Data

Nov. 28, 1988 [FR] France ..... 88 15531

[51] Int. Cl.[5] ..... B42D 1/08; B42D 3/06

[52] U.S. Cl. ..... 281/21.1; 40/530; 281/15.1; 281/48

[58] Field of Search ..... 281/48, 42, 45, 46, 281/47, 48, 15.1, 21.1; 412/33, 34; 402/80 P, 80 R; 40/530, 102

[56] References Cited

U.S. PATENT DOCUMENTS

| | | | |
|---|---|---|---|
| 460,090 | 9/1891 | Fitzpatrick et al. | 281/48 |
| 2,127,619 | 11/1936 | Rosenthal | 281/17 |
| 2,850,294 | 9/1958 | Ortis et al. | 40/530 |
| 3,074,744 | 1/1963 | Pucci | 281/37 |
| 3,353,844 | 11/1967 | Staats | 402/70 |
| 3,768,838 | 10/1973 | Shibata | 402/80 P |
| 3,793,758 | 2/1974 | Feldhausen et al. | 40/530 |
| 3,956,836 | 5/1976 | Seaborn | 40/530 |
| 4,180,341 | 12/1979 | Langhorst | 402/80 R |
| 4,294,029 | 10/1981 | Holson | 40/530 |
| 4,521,035 | 6/1985 | Berezowsky | 281/48 |
| 4,557,503 | 12/1985 | Linn | 281/47 |

FOREIGN PATENT DOCUMENTS

| | | |
|---|---|---|
| 2129317 | 2/1973 | Fed. Rep. of Germany . |
| 7332811 | 3/1974 | Fed. Rep. of Germany . |
| 3245730 | 6/1984 | Fed. Rep. of Germany . |
| 1256845 | 12/1961 | France . |
| 1560739 | 5/1969 | France . |
| 2127577 | 10/1972 | France . |
| 2142337 | 1/1973 | France . |
| 564239 | 7/1975 | Switzerland . |
| 1381169 | 1/1975 | United Kingdom . |

*Primary Examiner*—Paul A. Bell

*Attorney, Agent, or Firm*—Armstrong, Nikaido, Marmelstein, Kubovcik & Murray

[57] ABSTRACT

The binding for a book of samples, such as carpets or floor coverings, comprises a succession of adjacent binding elements (1 to 5) with an elongated shape and each equipped with sample-retaining means. The spine (11) of each retention element is provided on the one hand with an elongated tongue (12) with a flange (13), situated in the extension of the plane of the spine of the upper side of the element, and on the other hand with a longitudinal groove having an inclined narrow zone (14) adapted to interact with a portion of an elongated tongue.

8 Claims, 4 Drawing Sheets

BINDING FOR A SAMPLE BOOK

The present invention relates to a binding, in particular for a book, for example for a book of samples such as carpets or floor coverings, comprising a succession of adjacent binding elements with an elongated shape and each equipped with sample-retaining means, each binding element being connected in an articulated manner relative to the adjacent binding elements.

There are various types of binding which enable small-sized samples to be presented in the form of a book. A sample book is known from German Patent 2,129,317 having a certain number of retention bars which are interconnected so as to be able to pivot and they receive flat samples or rigid sheets serving as a sample support. In this document, each of the retention bars has a spine equipped with two longitudinal recesses. Each retention bar is connected to each of the two neighboring retention bars by a hinge strip which is elastically deformable and is defined by two flanges. Each flange is held in one of the said longitudinal recesses by their complementary shape so as to enable the retention bar to pivot relative to the adjacent retention bars. A sample book of this type has the disadvantage of being assembled from a substantial number of elements (retention bars and hinge strips separated from each other). This entails problems both in storage and in assembly, thus increasing the cost of manufacturing the books.

A binding with movable leaves which consists of several retention bars connected to each other in an articulated manner is, moreover, known from French Patent 2,127,577. Each retention bar has, on each of its two longitudinal edges of the spine, a groove or a flap provided with a flange. The retention bars are interconnected in an articulated manner by the flanged edge of one of them engaging in a complementary groove of another. The flanged flaps make an angle of approximately 45° relative to the plane of the spine of the retention bars and are curved so as to be engaged in a groove of an adjacent bar with a shape complementing the flange. The binding produced according to this document makes it possible to discard the separated hinge strips of the abovementioned German patent.

It should, however, be pointed out that, in both the German patent and in the French patent mentioned above, the hinge connection between two retention bars is made using a narrow strip on which concentrated bending stresses and tensile stresses are centered. The repeated opening and closing of the binding cause the stresses to which the said narrow strips are subjected to vary and easily give rise to impairments or even fractures as a result of the fatigue of the said narrow strips.

The object of the present invention is to overcome the disadvantages of the abovementioned binding systems by providing a simple and inexpensive binding.

Another objective of the invention is to reduce the risk of the hinge strips connecting the retention bars from being impaired by a better distribution of the stresses to which these hinge strips are subjected.

A further object of the invention is to provide retention bars using two materials which have different stiffnesses.

The binding according to the invention, intended in particular for books, for example books of samples such as carpets or floor coverings, comprises a succession of adjacent binding elements with an elongated shape and each equipped with a sample-retention means, with a spine opposite the retention means and with two sides, upper and lower respectively, the spine of each retention element being provided with a longitudinal projecting strip defined by a flange and with a longitudinal groove which complements the flanged strip enabling the binding elements to be connected in an articulated manner by engaging the flange strip of one element into the groove of an adjacent element. According to the invention, each of the said longitudinal strips consists of an elongated tongue, preferably having a length between five and fifteen times its thickness, located in the extension of the plane of the spine of the corresponding element of the upper side of the element. Each of the said longitudinal grooves has an inclined narrow zone adapted in order to interact with a portion of an elongated tongue.

Each binding element is advantageously provided with means for centering relative to the adjacent elements when the binding is closed with the result that, in the closed position, the binding has a spine which, as a whole, is substantially planar.

According to a preferred embodiment of the invention, each binding element exhibits, on its upper side, a longitudinal depression, one wall of which consists of the said flanged tongue. Each binding element has, on its lower side, a longitudinal shoulder defining the opening of the groove of the said element and interacting with the depression of the upper side of an adjacent element so as to guide the flanged tongue of the said adjacent element during the relative movement of the adjacent elements.

According to an advantageous embodiment of the invention, the centering means consist of a longitudinal recess on the upper side and of a longitudinal protuberance on the lower side of each of the binding elements, or vice versa. The said longitudinal recesses and the said longitudinal protuberances preferably have mutually complementary shapes. Each binding element advantageously exhibits a flanged tongue made from flexible plastic material and the remainder of the element is made from stiff plastic material. The binding elements are then preferably made from coextruded shaped sections.

The binding may have a particular binding element exhibiting, on the spine, a longitudinal shoulder onto which a handle is removably fitted in order to enable the binding to be gripped. It may also have an upper covering element and a lower covering element in order to protect the samples fastened in the book by the retention elements. The upper covering element exhibits a lower side which is identical to the lower side of the binding elements, whereas the lower covering element exhibits a flanged tongue and an upper side which is identical to the flanged tongues and to the upper side of the binding elements.

The invention will be better understood upon studying the detailed description of a particular embodiment of the invention, given by way of non-limiting example and illustrated by the attached drawings, in which.

Figure 1:
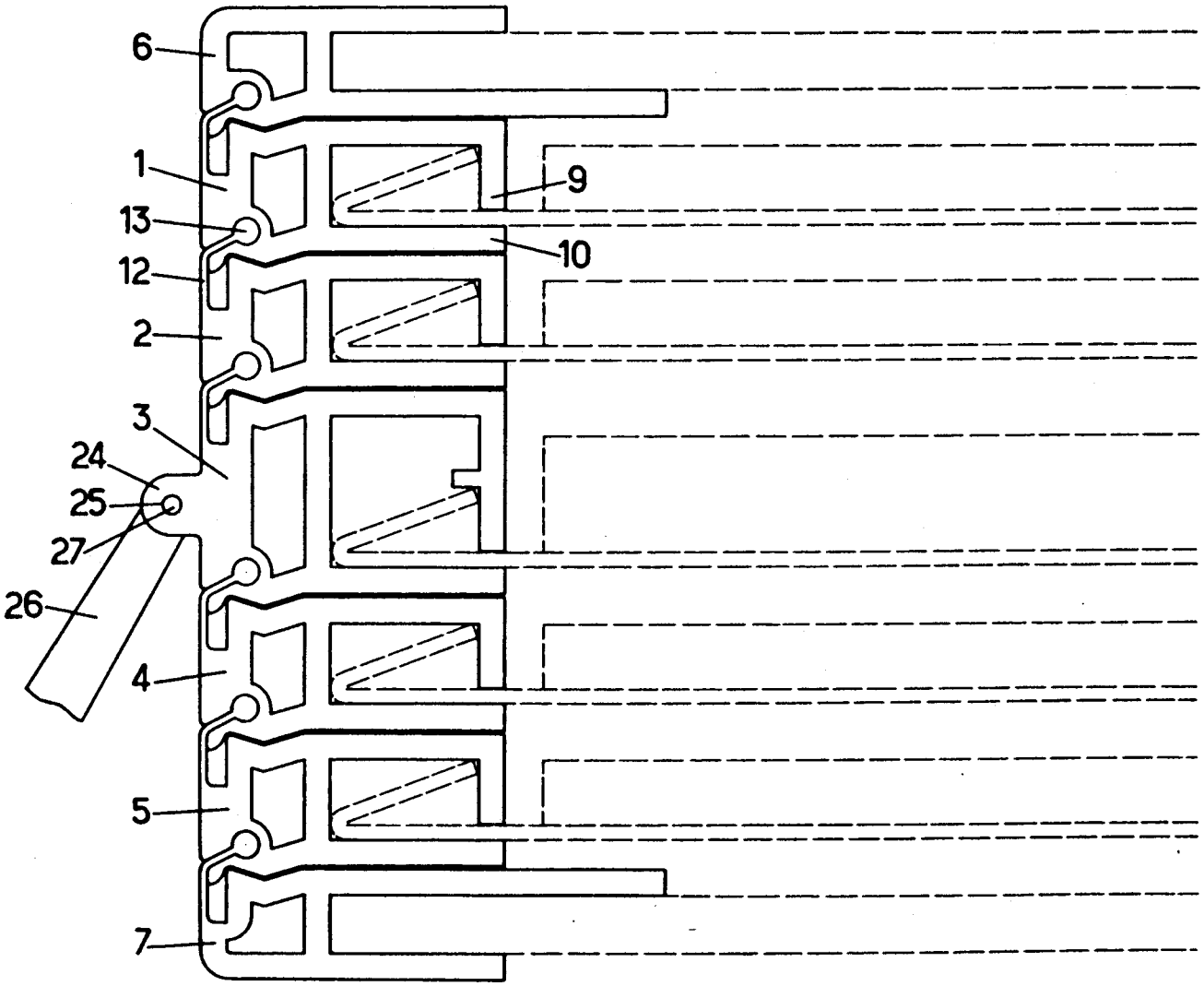
FIG. 1 is a side view of the binding for a sample book according to the invention in the closed position.
Figure 2:
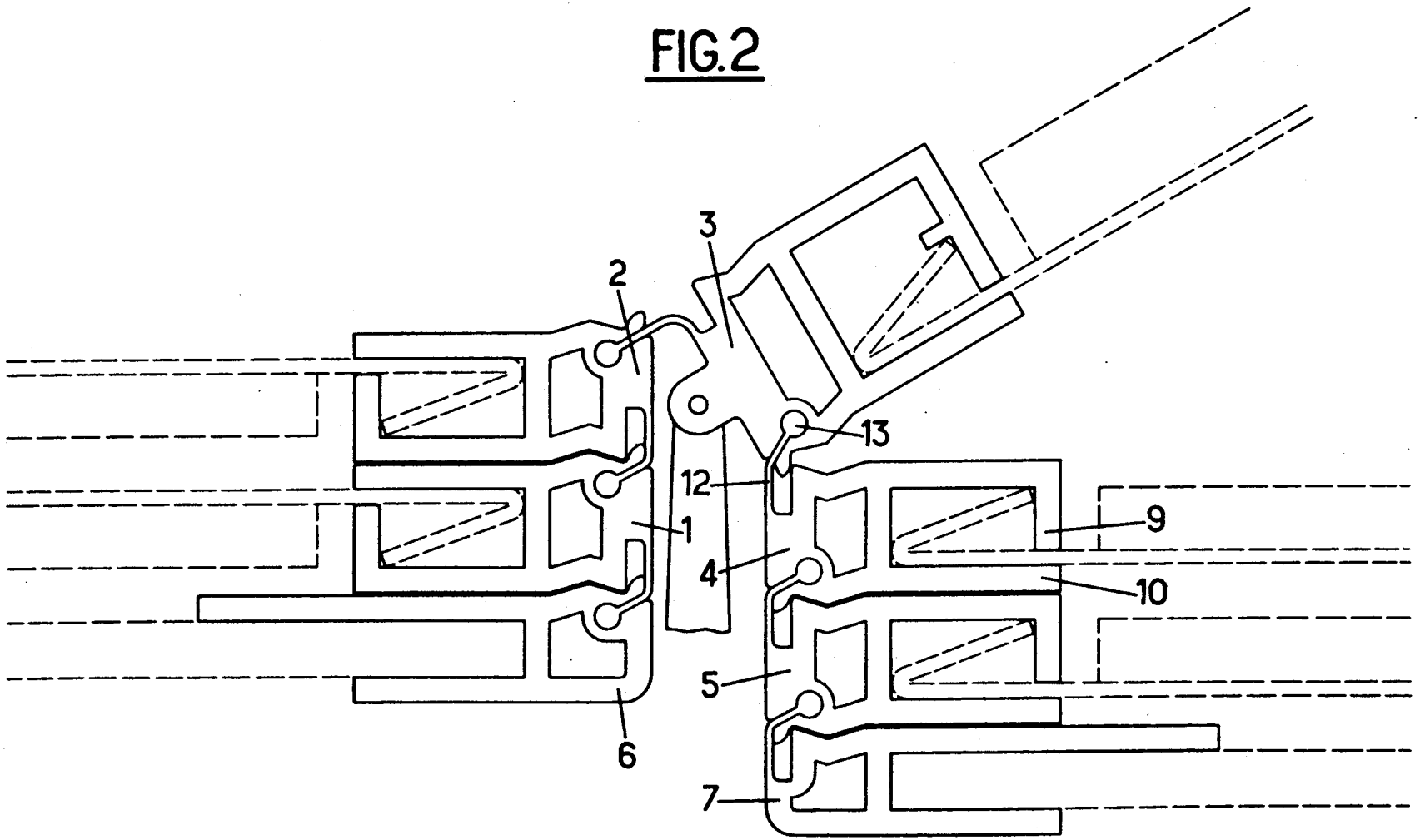
FIG. 2 is a side view showing the binding in FIG. 1 in the open position.

In this example, the binding is intended for a book for presenting flat products, in particular carpets and floor products. As illustrated in FIGS. 1 and 2, the binding has five binding elements with the references 1, 2, 3, 4 and 5 respectively, an upper covering element 6 and a lower covering element 7. Each of the elements 1 to 7 consists of a bar with a constant section which is obtained by extrusion.

Figure 3:
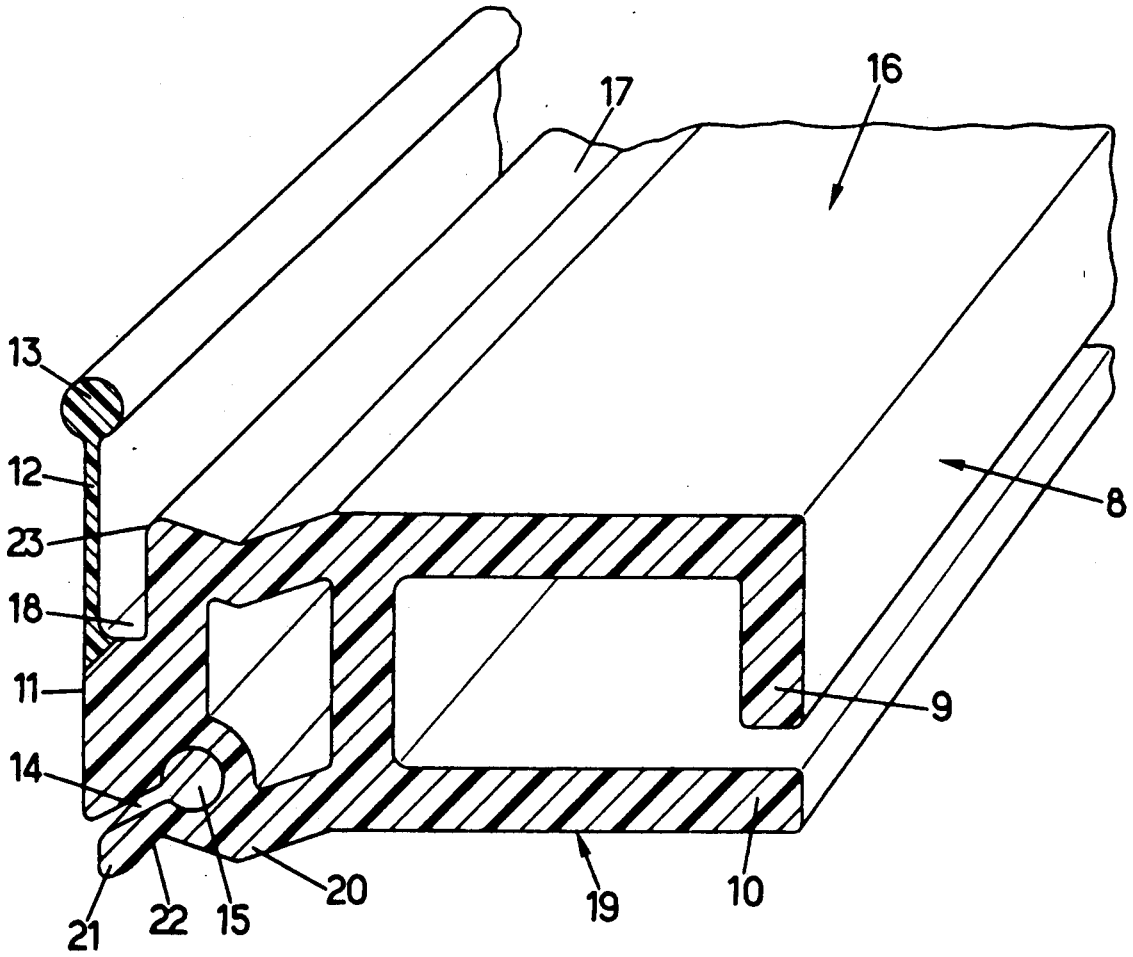
FIG. 3 is a partial sectional view of a retention element according to the present invention.

FIG. 3 shows in part a bar forming one of the binding elements 1, 2, 4 and 5. This binding element has a side forming a clamp 8 by elastic deformation of the limbs 9 and 10 of the element. For a plate with a thickness greater than the opening between the limbs 9 and 10 of the bar, in order to introduce the plate the limbs must be opened out, increasing the opening. The elasticity of the bar tends to return the limbs 9 and 10 to their initial position so as to retain the plate with a clamping force.

The side of the bar situated opposite the side forming a clamp 8 forms the spine 11 of the bar. The spine 11 is flat and is extended upwards in its plane by an elongated tongue 12, the upper end of which is produced in the form of a flange 13. The lower end of the spine 11 has an inclined groove consisting of a communicating elongated slot 14 and a longitudinal recess 15. The width of the slot 14 corresponds substantially to the thickness of the tongue 12. The section of the longitudinal recess 15 corresponds substantially to the section of the flange 13 of the tongue 12. The sections are substantially circular in this example.

The upper side 16 of the bar has a V-shaped longitudinal recess 17 and is separated from the tongue 12 by a longitudinal depression 18. The lower side 19 of the bar has a V-shaped longitudinal protuberance 20 which complements the longitudinal recess 17 of the upper side 16. The lower side 19 is separated from the spine 11 by a longitudinal shoulder 21 defining the opening of the slot 14. The shoulder 21 exhibits a face substantially parallel to the spine 11 and slightly set back relative to the plane of the spine 11. The offset between the two faces corresponds substantially to the thickness of the tongue 12.

The shoulder 21 and the protuberance 20 of the lower side 19 are separated by a rounded recess 22 perpendicular to the edge 23 formed between the recess 17 and the depression 18 of the upper side 16.

When two binding elements are assembled on top of each other, the lower side 19 of the upper element is placed on the upper side 16 of the lower element. The longitudinal protuberance 20 of the upper element interacts with the longitudinal recess 17 of the lower element by means of their complementary shape which forms a means for centering and maintaining alignment between the two elements.

The upper part of the tongue 12 of the lower element is engaged into the groove 14, 15 of the upper element by their complementary shape, thus forming a mechanical connection between the two elements. The offset between the spine 11 and the longitudinal shoulder 21 of the upper element makes it possible to guide the tongue more accurately towards the opening of the groove 14, 15 whilst at the same time obtaining a substantially plane surface of the respective spines of the two elements. The shoulder 21 of the upper element is located in the depression 18 of the lower element. The longitudinal recess 22 of the upper element is in contact with the edge 23 of the upper side of the lower element.

As a result of the flexibility of the elongated tongue which makes the connection between the two elements, the upper element can pivot relative to the lower element. During the pivoting, the longitudinal recess 22 of the upper element slides on the edge 23 of the lower element until the longitudinal shoulder 21 of the upper element has been freed from the longitudinal depression 18 of the lower element. The flexibility of the connecting tongue makes it possible for the upper element to pivot by up to 180° relative to the lower element. The elongated shape of the tongue makes it possible to distribute the bending stresses over a large length of the tongue, thus avoiding any concentration of stresses which could cause the tongue to be impaired.

A tongue with an elongated shape is taken to be a tongue having a length greater than five times its thickness. In a particularly satisfactory example, this length is equal to approximately ten times the thickness of the tongue.

Moreover, the longitudinal shoulder 21 of the upper element, as well as the slot 14 of the upper element, enables a better distribution of the stresses on the connecting tongue caused by the mechanical contact of the two elements.

The binding elements may be identical or different, depending on the thickness of the samples positioned on the support plates. The upper and lower sides and the connecting parts (flanged tongues and grooves) must have identical structural features, whatever the binding elements.

The means for retaining the plates which serve as sample supports may take various forms, for example clips or removable tenons. In this embodiment, the means for retaining the plates which serve as sample supports consist of the limbs 9 and 10 exerting a clamping force. The corresponding part must therefore be made with a stiff and elastic material, for example made from stiff plastic material. On the other hand, the tongue 12 must be sufficiently flexible to enable the elements to pivot relative to each other. It is possible, for example, to produce elements of this type by coextrusion of a flexible plastic material for the tongue and of a rigid plastic material for the remainder of the binding element.

Referring once more to FIGS. 1 and 2, the operation of the binding of the invention can now be better understood. Each binding element 1 to 5 holds a rigid plate, in a manner known per se, on which one or more flat sample(s) are fastened. The binding element 3, situated in the middle of the binding, is slightly wider than the other binding elements 1, 2, 4 and 5, and is reinforced on the spine by a longitudinal shoulder 24 equipped with an axial hole 25. A handle 26 interacts with the shoulder 24 for gripping the binding.

In the closed position, the elements are placed on top of each other, forming a spine for the binding which is on the whole substantially planar. The flanged tongues are engaged into grooves of the adjacent elements by their complementary shape. As a result of the flexibility of the tongues, it is possible to open the binding by pivoting the elements relative to each other. For closing the binding, the profile of the upper and lower sides makes it possible for the elements to center automatically relative to each other. The inclination of the grooves of the elements is preferably selected such that the connecting tongues are subjected to bending stresses which are substantially identical in the closed position and the open position of the binding.

Figure 4:
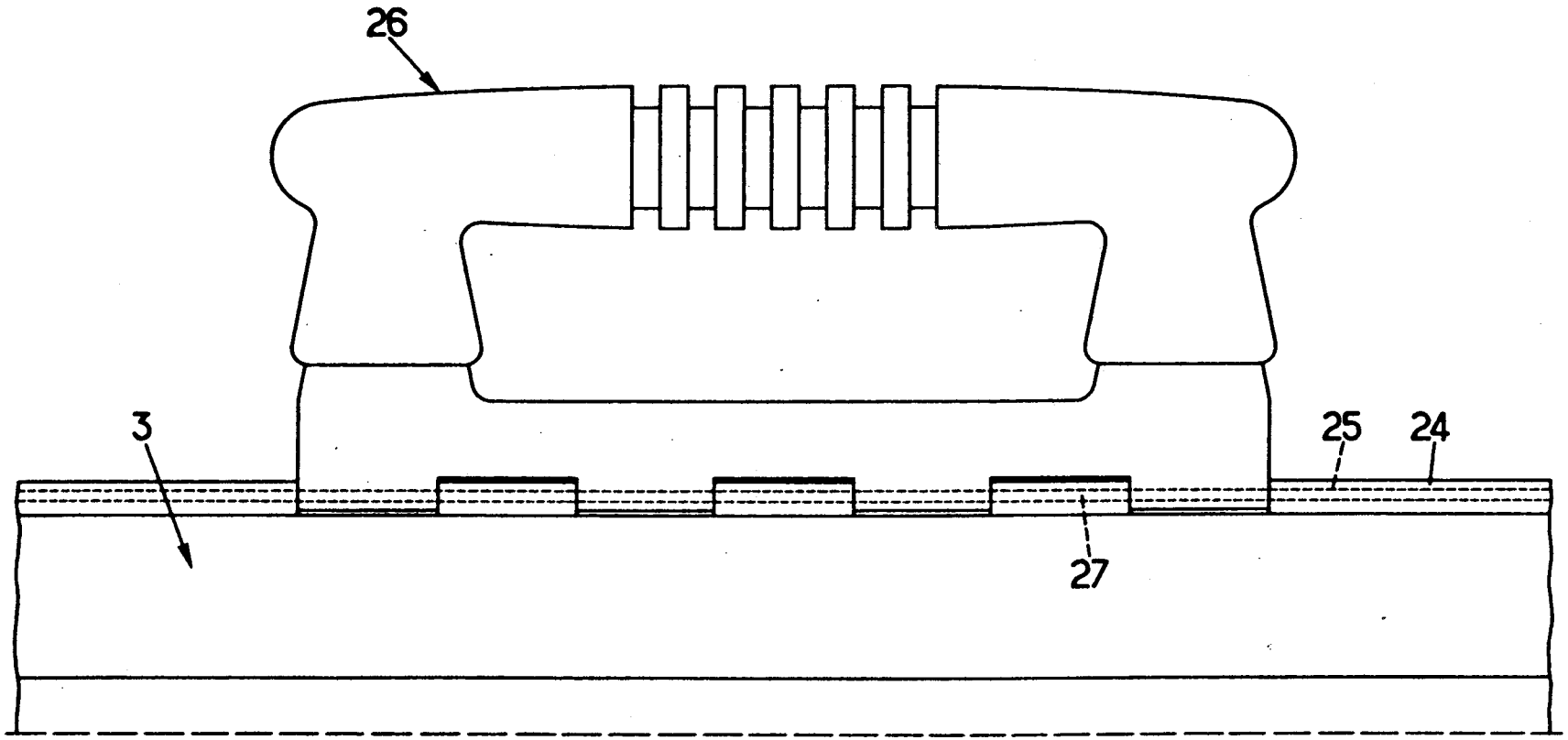
FIG. 4 is a view showing a handle for the binding according to the invention.

A handle 26 assembled pivotably on the longitudinal shoulder 24 of the central binding element 3 is shown in FIG. 4. A shaft 27, about which the handle 26 can pivot, is engaged into the longitudinal hole 25 of the shoulder 24.

In this embodiment, the upper 16 and lower 19 sides of the retention elements are defined according to FIG. 1 when the binding is in the closed position. The presence of a recessed part between the longitudinal recess 17 of the upper side 16 and the longitudinal protuberance 20 of the lower side 19, illustrated in this example, is not, however, indispensable for the retention elements and may be replaced by a solid part.

I claim:

1. A binding assembly for a sample book having a plurality of adjacent parallel binding elements interconnected at one edge thereof, each binding element comprising:

an elongated body having an upper side, a lower side, and a front edge provided with sample retaining means opposite a rear edge;

said rear edge being provided at a midpoint with a longitudinal tongue projecting upwards and terminating in a flange, and at a lower end with a longitudinal groove complementary to said longitudinal tongue;

a longitudinal depression formed in said upper side along said longitudinal tongue;

said complementary longitudinal groove including an inclined narrow zone shaped to accommodate said tongue and a recess shaped to accommodate said flange, such that said tongue and flange of each of said binding elements will fit to a groove and recess, respectively, of adjacent binding elements.

2. A binding assembly according to claim 1, further comprising centering means for positioning a bonding element relative to adjacent binding elements, said centering means comprising a longitudinal recess formed in one of said upper and lower sides, and a complementary longitudinal protuberance formed in the other one of said sides, such that adjacent binding elements are maintained in alignment in a closed condition of said sample book.

3. A binding assembly according to claim 1 or 2, wherein said elongated body further includes a longitudinal shoulder at the lower side along said longitudinal groove narrow zone, said shoulder interacting with the longitudinal depression of a lower adjacent binding element so as to guide adjacent biding elements in relative movement.

4. A binding assembly according to claim 2, wherein said complementary longitudinal recess and protuberance have a V-shaped cross-section.

5. A binding assembly according to claim 1 or 2, wherein a portion of said elongated body including said rear edge and said front edge is formed of stiff plastic material, and said longitudinal tongue and flange are formed, integral with said body portion, of flexible plastic material.

6. A binding assembly according to claim 1 or 2, wherein one of said binding elements further includes at its rear edge a longitudinal shoulder and a removable pivoting handle fitted to said shoulder.

7. A binding assembly according to claim 1 or 2, further including an upper covering element having a lower side identical to the lower side of the binding elements, and a lower covering element having a flanged longitudinal tongue and an upper side identical respectively to the flanged tongue and the upper side of the binding elements.

8. A binding assembly according to claim 1 or 2, wherein said longitudinal tongue has a length between 5 and 15 times it thickness.

* * * * *